US006508334B1

(12) United States Patent
Matsuda et al.

(10) Patent No.: US 6,508,334 B1
(45) Date of Patent: Jan. 21, 2003

(54) ELEVATOR DESTINATION REGISTERING APPARATUS FOR DISPLAYING ROUTE TO A DESTINATION POINT

(75) Inventors: Kazuko Matsuda, Tokyo (JP); Masayuki Miyawaki, Tokyo (JP); Mitsuhiko Yamamoto, Tokyo (JP); Yasuyuki Tamaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 256 days.

(21) Appl. No.: 09/979,152

(22) PCT Filed: Jun. 21, 2000

(86) PCT No.: PCT/JP00/04058

§ 371 (c)(1),
(2), (4) Date: Nov. 20, 2001

(87) PCT Pub. No.: WO01/98191

PCT Pub. Date: Dec. 27, 2001

(51) Int. Cl.[7] ..... B66B 3/00
(52) U.S. Cl. ..... 187/391; 187/396
(58) Field of Search ..... 187/391, 393, 187/396, 414

(56) References Cited

U.S. PATENT DOCUMENTS

| | | | | |
|---|---|---|---|---|
| 5,551,533 A | * | 9/1996 | Ng | 187/390 |
| 6,062,346 A | * | 5/2000 | Friedli et al. | 187/395 |
| 6,315,083 B1 | * | 11/2001 | Schuster et al. | 187/380 |
| 6,341,668 B1 | * | 1/2002 | Fayette et al. | 187/247 |

FOREIGN PATENT DOCUMENTS

| | | | | |
|---|---|---|---|---|
| JP | 63-181099 | | 7/1988 | |
| JP | 6-64856 | | 3/1994 | |
| JP | 6-212589 | | 8/1994 | |
| JP | 06321445 A | * | 11/1994 | 187/391 |
| JP | 7-187533 | | 7/1995 | |
| JP | 9-118484 | | 5/1997 | |
| JP | 10-194618 | | 7/1998 | |

* cited by examiner

*Primary Examiner*—Jonathan Salata
(74) *Attorney, Agent, or Firm*—Leydig, Voit & Mayer, Ltd.

(57) ABSTRACT

In a destination registering apparatus for an elevator, a hall operating panel includes with a hall display device and a ten-key numerical input device. Information, i.e., the layout of a destination floor and a route to a destination point, stored in a storage device are selected by a selection circuit and displayed on a hall display device by inputting information, such as a room number or the like, to the ten-key numerical input device.

14 Claims, 16 Drawing Sheets

ELEVATOR DESTINATION REGISTERING APPARATUS FOR DISPLAYING ROUTE TO A DESTINATION POINT

TECHNICAL FIELD

The present invention relates to a destination registering apparatus for an elevator, which is installed at an elevator hall or in a car for registering the destination of the car.

BACKGROUND ART

Conventionally, as disclosed in Japanese Patent Application Laid-Open No. Hei 10-194618 for example, there is a hall call registering apparatus for an elevator in which the layout of the destination floor and the route to a destination point are displayed on a display provided in a car by designating the destination point at the elevator hall.

Such an apparatus may be utilized in an elevator installed in a department store or the like, and users can confirm in the car the layout of a whole floor including retail areas and routes from the car to a retail area by registering the retail area as the destination point.

However, it is undesirable for the above described apparatus to be utilized as is in an elevator installed, for example, in a hotel, because the display can be seen by all the passengers in the car and a destination point, i.e., the room number and position of the guest room can be seen by a stranger if the stranger is in the car. Further, since the layout and the route are only displayed for a short time just before the car arrives at the destination floor, there is a strong possibility that the user will forget to look at the display when there is an extended period time between registering the destination point at the elevator hall and arrival at the destination floor.

DISCLOSURE OF THE INVENTION

The present invention is made to solve the problems mentioned above, and an object of the present invention is to provide a destination registering apparatus for an elevator, which can display the layout of a destination floor and the route to a destination point preferentially to a passenger who has input the destination point.

To this end, according to one aspect of the present invention, there is provided a destination registering apparatus for an elevator comprising: an input device for inputting information assigning a destination point, provided at an elevator hall; a storage device storing layout information for every floor and information of routes from the elevator halls of every floor to every destination point; a selection circuit for selecting information corresponding to the destination point input to the input device from information stored in the storage device; a hall display device for displaying information selected by the selection circuit, provided at the elevator hall; and a CPU for outputting destination registering signals to an elevator control device and outputting information selecting signals to the selection circuit according to the information input by the input device.

According to another aspect of the present invention, there is provided a destination registering apparatus for an elevator comprising: an input device for inputting information assigning a destination point, provided in a car; a car operating panel having a car display device for displaying an image to a passenger who has operated the input device; a storage device storing layout information for every floor and information of routes from the elevator halls of every floor to every destination point; a selection circuit for selecting information corresponding to the destination point input to the input device from information stored in the storage device to display the information on the car display device; and a CPU for outputting destination registering signals to an elevator control device and outputting information selecting signals to the selection circuit according to the information input by the input device.

BEST MODE FOR CARRYING OUT THE INVENTION

Preferred embodiments of the present invention will be described below with reference to the accompanying drawings.

First Embodiment

Figure 1:
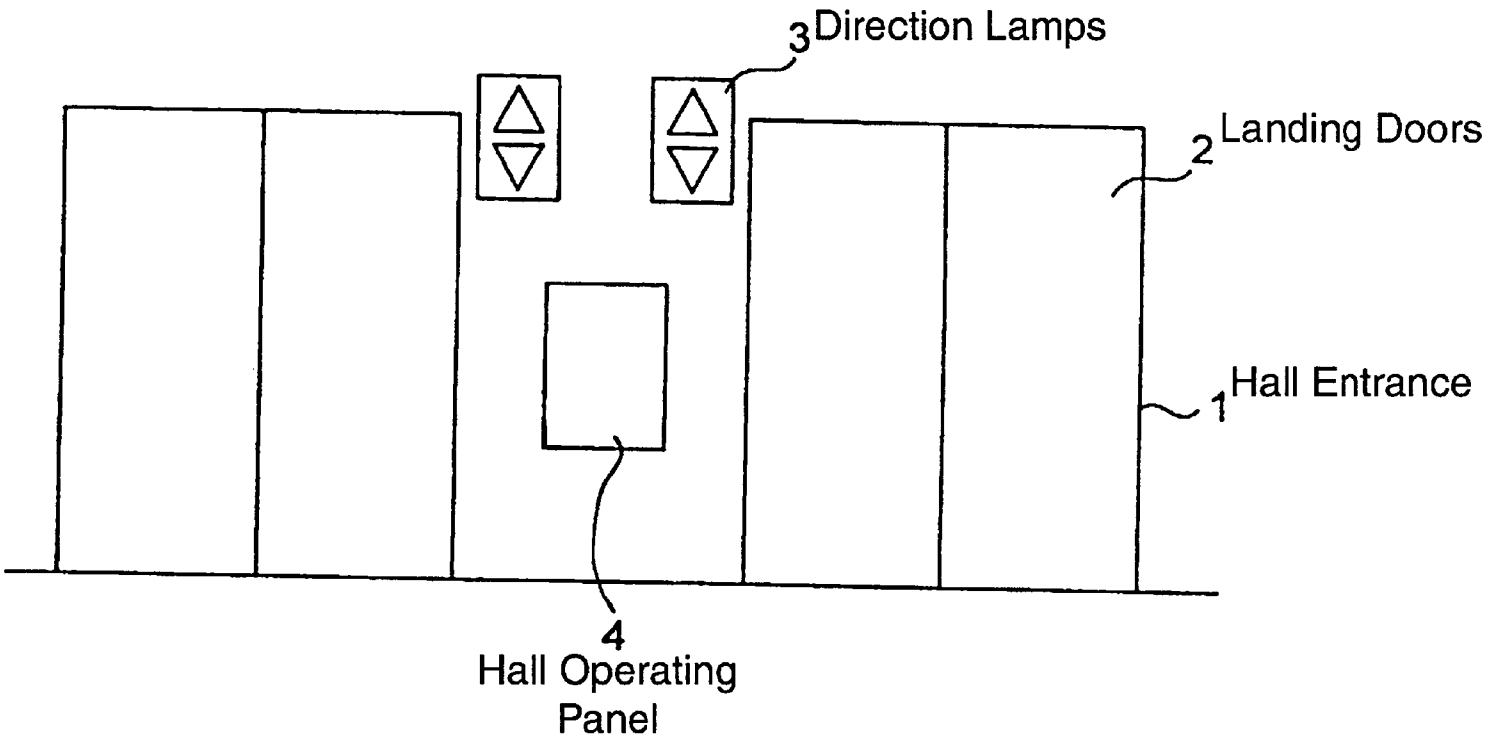
FIG. 1 is a front view showing an elevator hall according to a first embodiment of the present invention.

FIG. 1 is a front view showing an elevator hall according to a first embodiment of the present invention. More particularly an elevator installed at a hotel will be described below. In the figure, a plurality of hall entrances 1 are provided at an elevator hall. Each hall entrance 1 is opened and closed by a plurality of landing doors 2. A plurality of direction lamps 3 showing moving directions of corresponding cars (not shown) are provided nearby the hall entrances 1. Further, a hall operating panel 4 is disposed below the direction lamps 3.

Figure 2:
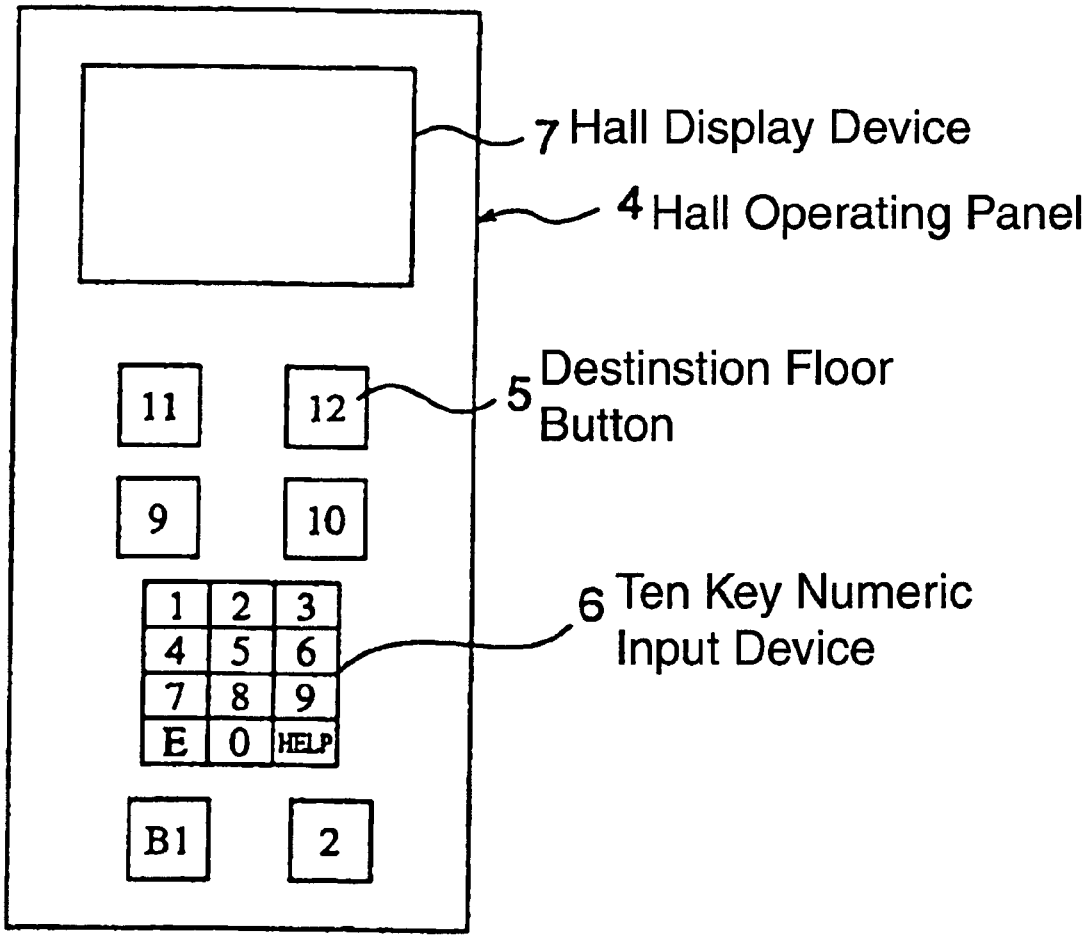
FIG. 2 is a front view showing the hall operating panel in FIG. 1.

FIG. 2 is a front view showing the hall operating panel in FIG. 1. The hall operating panel 4 is provided with destination floor buttons 5 for designating destination floors, a ten-key numerical input device 6 for inputting room numbers as destination points, and a hall display device 7 for displaying images to users who have operated the ten-key numerical input device 6.

In this embodiment, the operations of the elevator for guest room floors used only by staying guests are controlled by the ten-key numerical input device 6. Further, the operations of the elevator for floors such as a reception desk floor, a restaurant floor and the like, also used by general users are controlled by the destination floor buttons 5.

Figure 3:
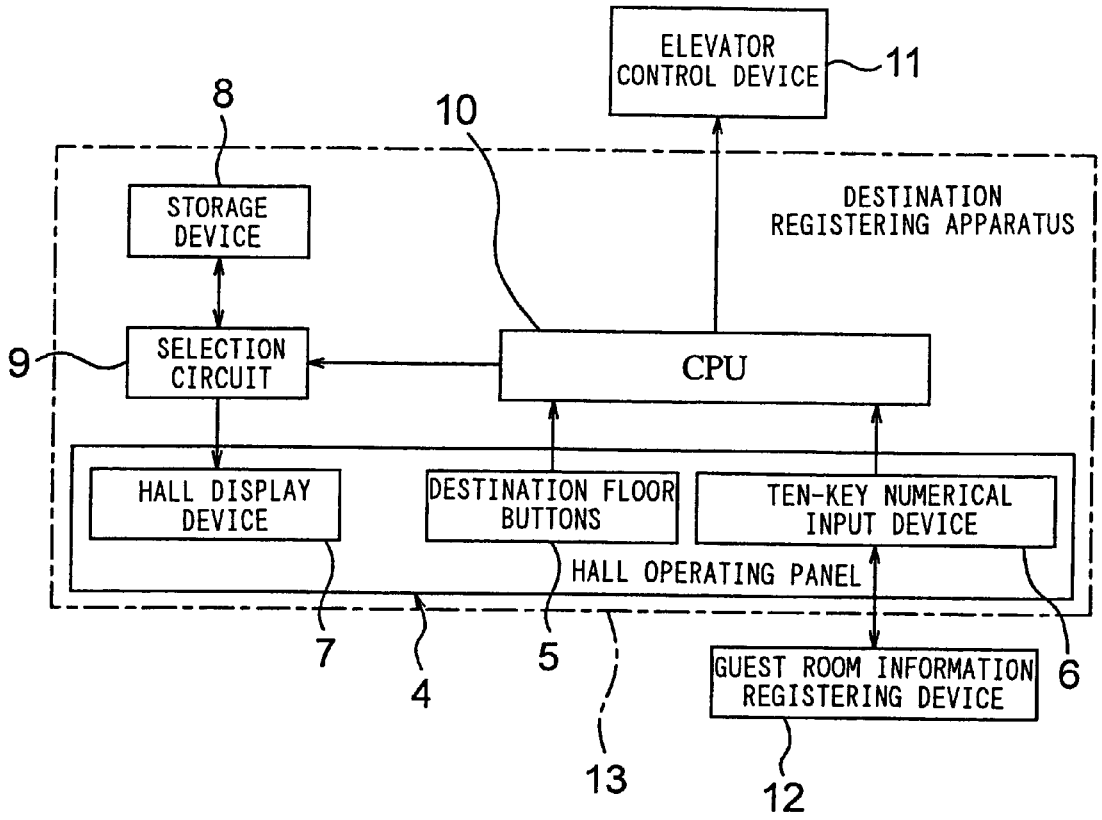
FIG. 3 is a block diagram showing a destination registering apparatus according to the first embodiment.

FIG. 3 is a block diagram showing a destination registering apparatus according to the first embodiment. A storage device 8 stores layout information for every floor and information of routes from the halls of every floor to every destination point. The information corresponding to the destination point input to the destination floor buttons 5 or the ten-key numerical input device 6 is selected by a selection circuit 9 from the information stored in the storage device 8 and displayed on the hall display device 7.

Signals from the destination floor buttons 5 and the ten-key numerical input device 6 are input to a CPU (central processing unit) 10. Signals for registering the destinations are output to an elevator control device 11 by the CPU 10 in accordance with the input information. Also, signals for selecting the information are output to the selection circuit 9 by the CPU 10. The ten-key numerical input device 6 is connected with a guest room information registering device 12 in which room numbers of available rooms are registered.

A destination registering apparatus 13 according to the first embodiment has the destination floor buttons 5, the ten-key numerical input device 6, the hall display device 7, the storage device 8, the selection circuit 9 and the CPU 10.

Figure 4:
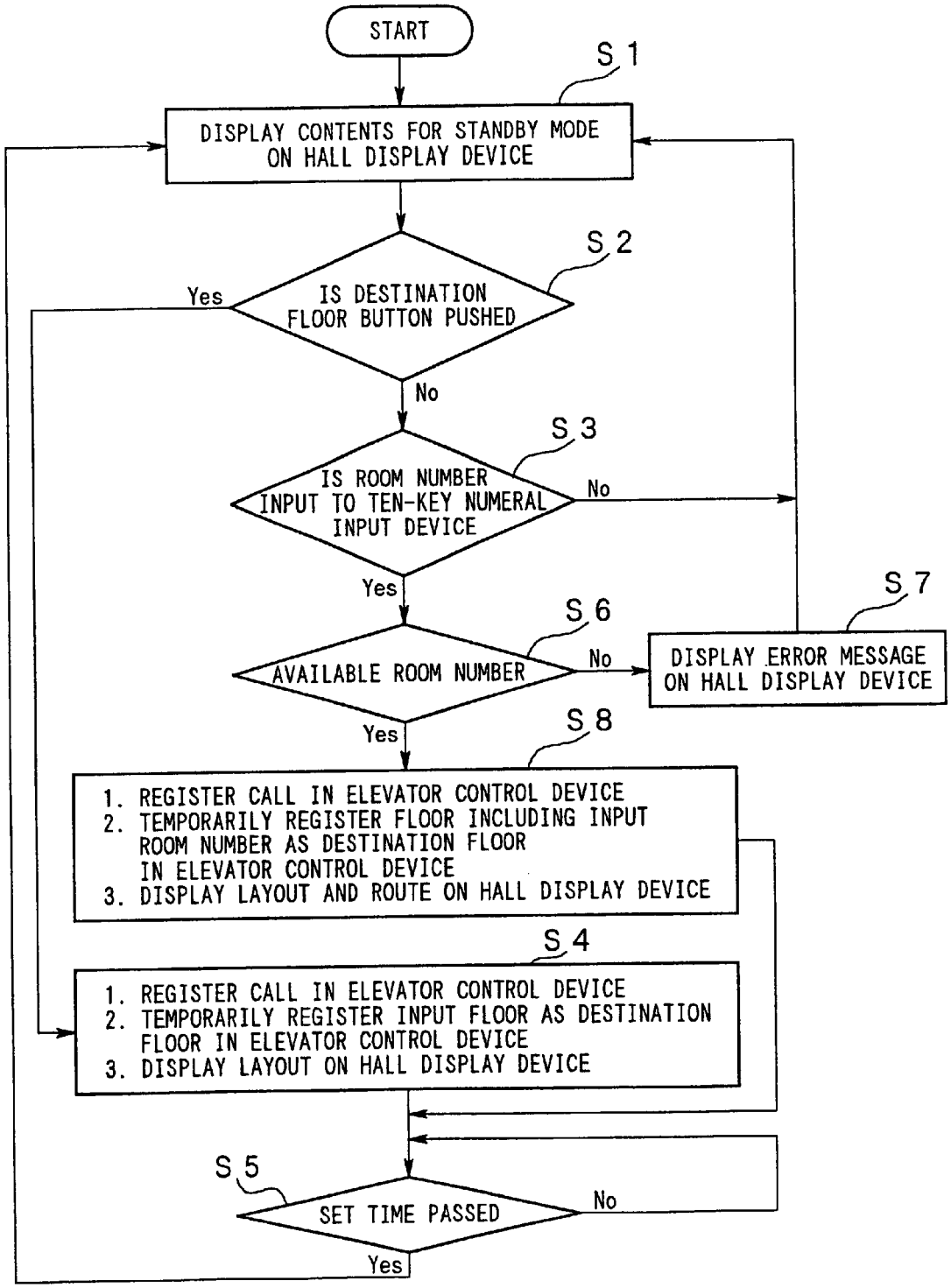
FIG. 4 is a flow chart showing a control method of the destination registering apparatus in FIG. 3.

Next, operation will be described. FIG. 4 is a flow chart showing a control method of the destination registering apparatus in FIG. 3. First, display contents such as input waiting messages such as "please enter a destination" or the like, or information on events in a building, are displayed on the hall display device 7 during standby mode (step S1). Then, it is normally checked to see whether a destination floor button 5 is pushed or not (step S2), or whether the room number is input to the ten-key numerical input device 6 (step S3). If no input is received from either the destination floor buttons 5 or the ten-key numerical input device 6, the standby mode display continues.

Further, if a destination floor button 5 is pushed, a call is registered in the elevator control device 11, the input floor is temporarily registered in the elevator control device 11 as the destination floor, and the layout of the input floor is displayed on the hall display device 7 (step S4).

Figure 5:
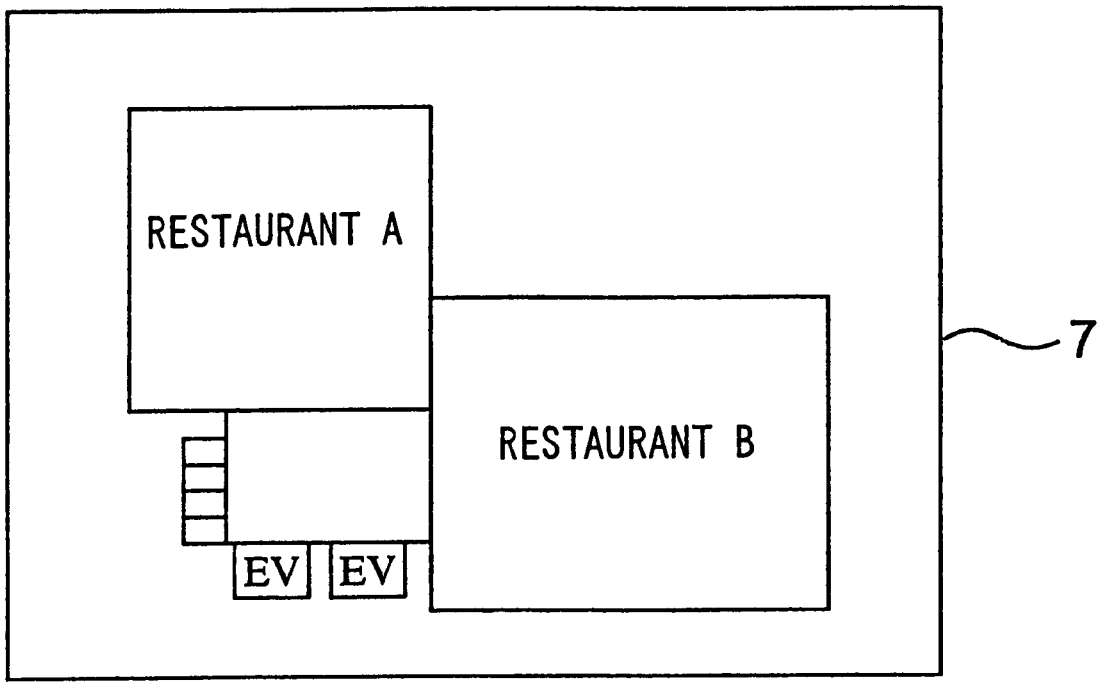
FIG. 5 is a front view showing an example of display contents of the hall display device when the destination floor buttons in FIG. 2 are pushed.

FIG. 5 is a front view showing an example of the display contents of the hall display device 7 when the destination floor buttons 5 in FIG. 2 are pushed. In FIG. 5, the layout of a restaurant floor is displayed on the hall display device 7. Such a display of the layout is performed only for a time previously set in a timer circuit in the selection circuit 9 (step S5), and the display on the hall display device 7 reverts back to the contents for standby mode after the set time passes.

On the other hand, if a room number is input to the ten-key numerical input device 6, it is checked to see whether the input room number is registered in the guest room information registering device 12 or not (step S6). In the case of no registration, the guest room of the input number is judged not to be available, and an error message is displayed on the hall display device 7 (step S7). Then, the call registration is refused, and the display reverts back to the standby state.

In the case where the input room number has been registered in the guest room information registering device 12, the call is registered in the elevator control device 11, the floor including the input room number is temporarily registered in the elevator control device 11 as the destination floor, and the layout of the corresponding floor and the route to the guest room that is the destination point are displayed on the hall display device 7 (step S8).

Figure 6:
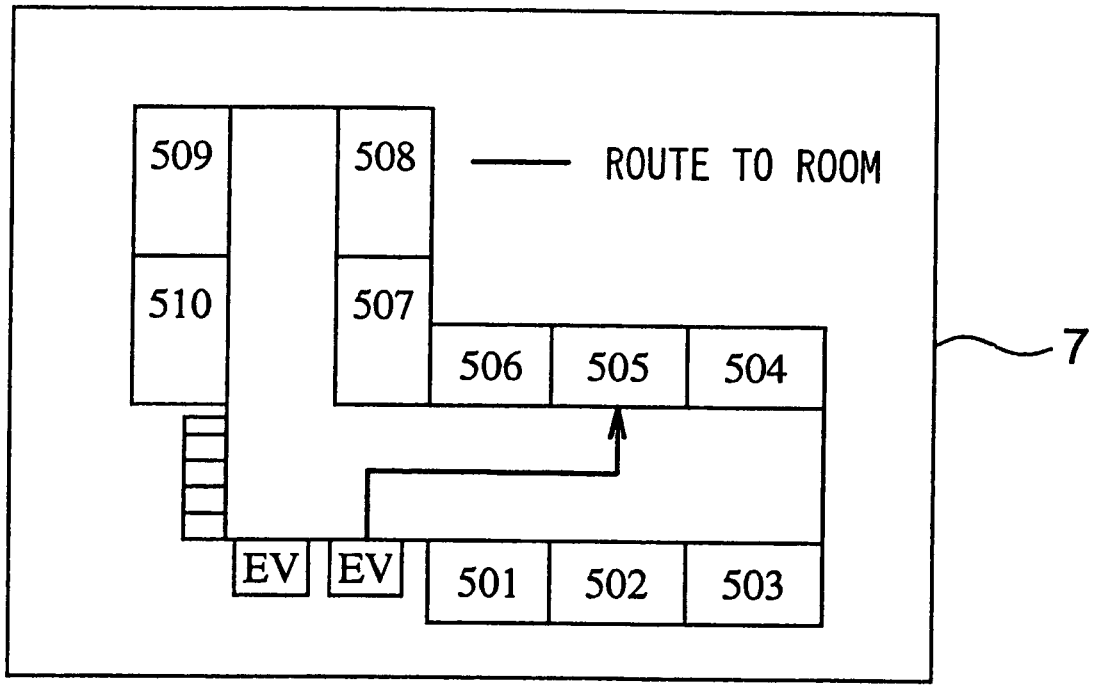
FIG. 6 is a front view showing an example of the display contents of the hall display device when the ten-key numerical input device in FIG. 2 is operated.

FIG. 6 is a front view showing an example of the display contents of the hall display device 7 when the ten-key numerical input device 6 in FIG. 2 is operated. Such a display of the layout and the route is performed only for a time previously set (step S5), and the display in the hall display device 7 reverts back to the contents for standby mode after the set time passes.

Figure 7:
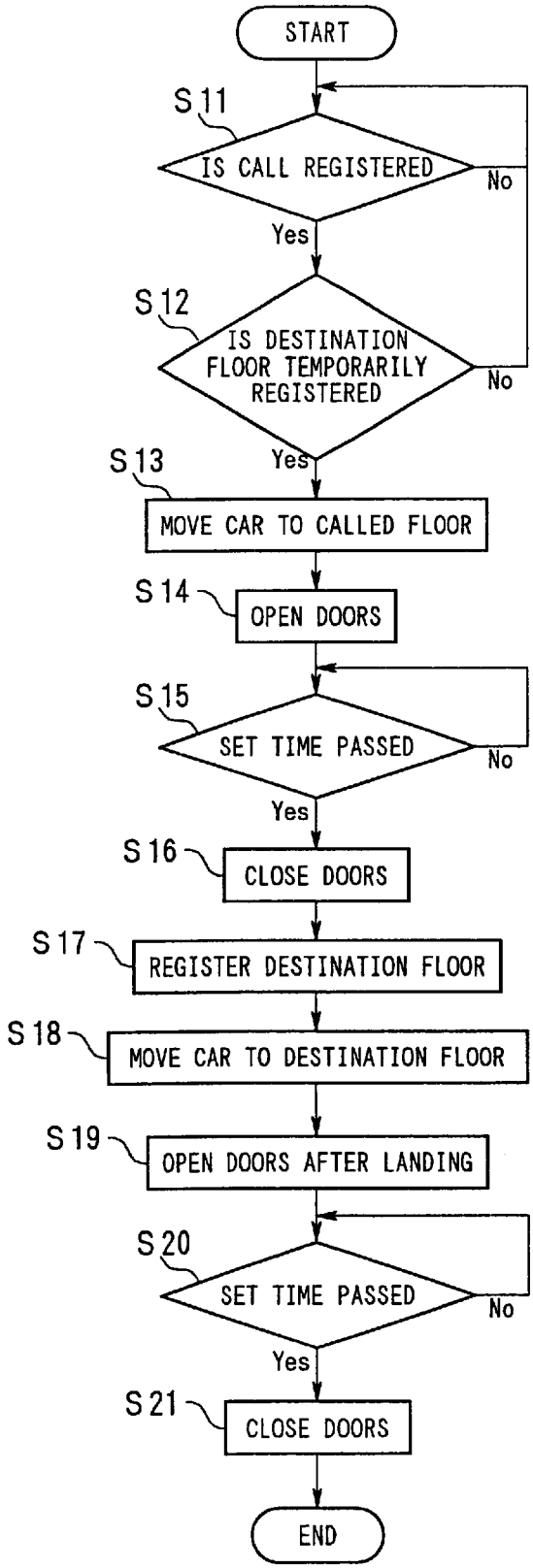
FIG. 7 is a flow chart showing a control method for the elevator control device in FIG. 3.

Next, FIG. 7 is a flow chart showing a control method for the elevator control device 11 in FIG. 3. In the elevator control device 11, it is normally checked to see whether a call is registered by the CPU 10 or not (step S11). Then, if a call is registered, it is checked to see whether the destination floor is temporarily registered or not (step S12). If the call is registered and the destination floor is temporarily registered, the car is moved to the called floor (step S13), and the landing doors 2 and car doors (not shown) are opened (step S14).

When the previously set time passes after opening the doors (step S15), the landing doors 2 and the car doors are closed (step Sl6). After this, the destination floor is registered (step S17) and the car is moved to the destination floor (step S18). After the car arrives at the destination floor and is landed, the landing doors 2 and the car doors are opened (step S19). When the time previously set passes after opening the doors (step S20), the landing doors 2 and the car doors are closed (step S21).

In the destination registering apparatus for the elevator as described above, since the layout of the destination floor and the route to the guest room are displayed on the hall display device 7 of the same hall operating panel 4 by inputting the room number to the ten-key numerical input device 6 provided at the hall operating panel 4, the display contents are not seen by other users. Also, since the layout and the route are quickly displayed after inputting the room number, there is no fear that the user will forget to look at the display.

Further, since the ten-key numerical input device 6 is connected to the guest room information registering device 12 and it is checked to see whether the input room number is an available number or not, the strangers can be restrained from arbitrarily entering a guest room floor by operating the ten-key numerical input device 6.

Second Embodiment

Figure 8:
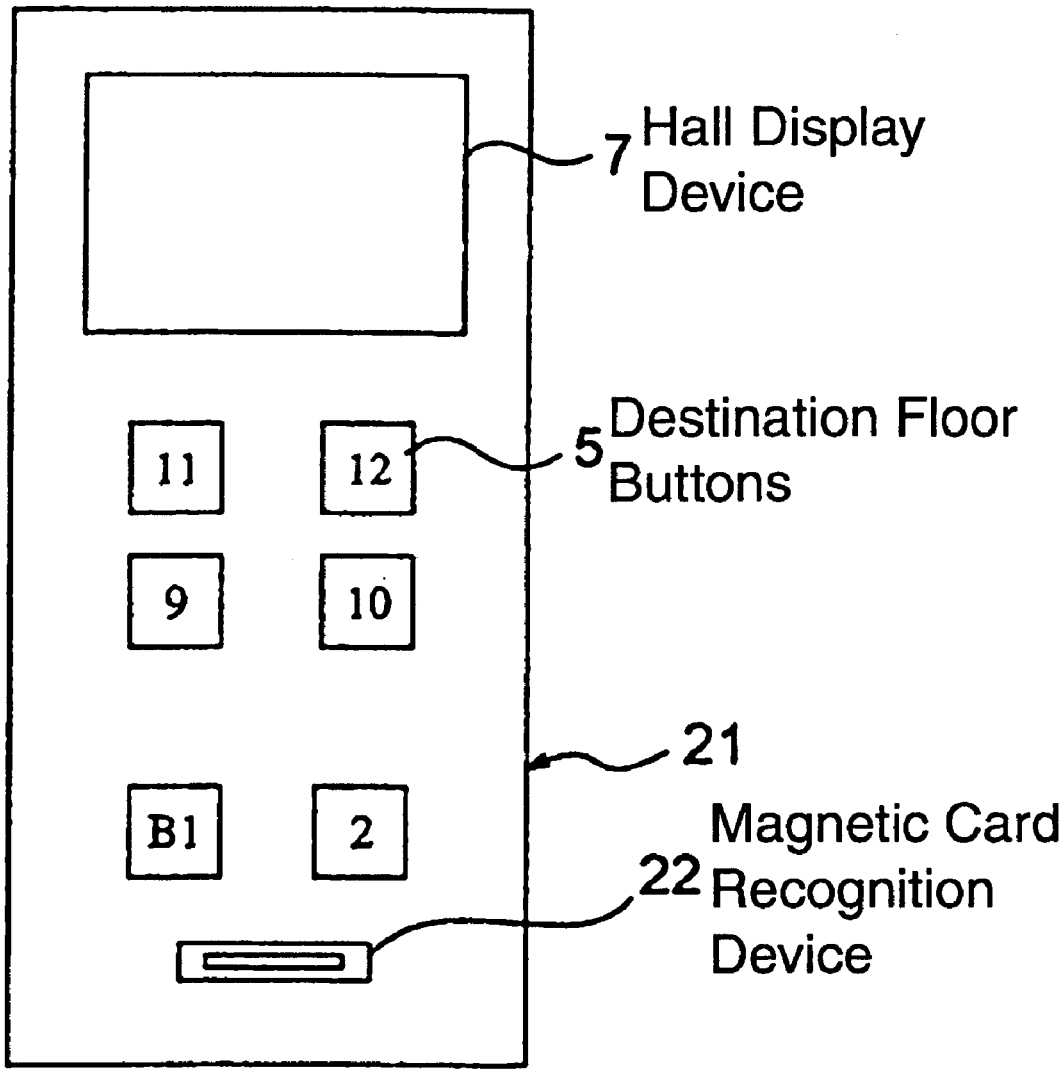
FIG. 8 is a front view showing a hall operating panel of a destination registering apparatus according to a second embodiment of the present invention.
Figure 9:
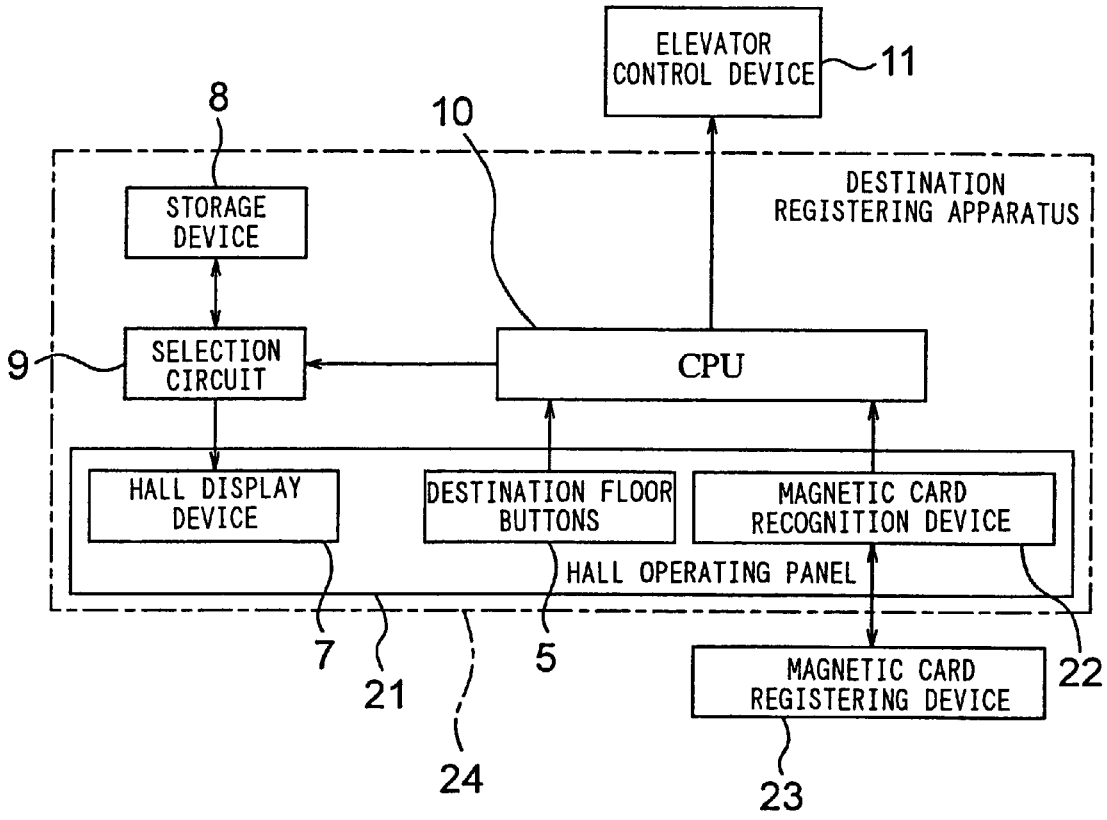
FIG. 9 is a block diagram showing a destination registering apparatus according to the second embodiment.

Next, FIG. 8 is a front view showing a hall operating panel of a destination registering apparatus according to a second embodiment of the present invention, and FIG. 9 is a block diagram showing a destination registering apparatus according to the second embodiment. In the second embodiment, a magnetic card recognition device 22 as an input device is used in a hall operating panel 21. The magnetic card recognition device 22 is a device for reading magnetic data in magnetic cards (not shown) that users have. Information such as the room number in a hotel or the like is registered in the magnetic card which is also used as a room key.

The magnetic card recognition device 22 is connected with a magnetic card registering device 23 in which information of the magnetic card corresponding to available room numbers are registered.

A destination registering apparatus 24 according to the second embodiment has the destination floor buttons 5, the magnetic card recognition device 22, the hall display device 7, the storage device 8, the selection circuit 9 and the cPu 10. The other constructions are the same as in the first embodiment.

Figure 10:
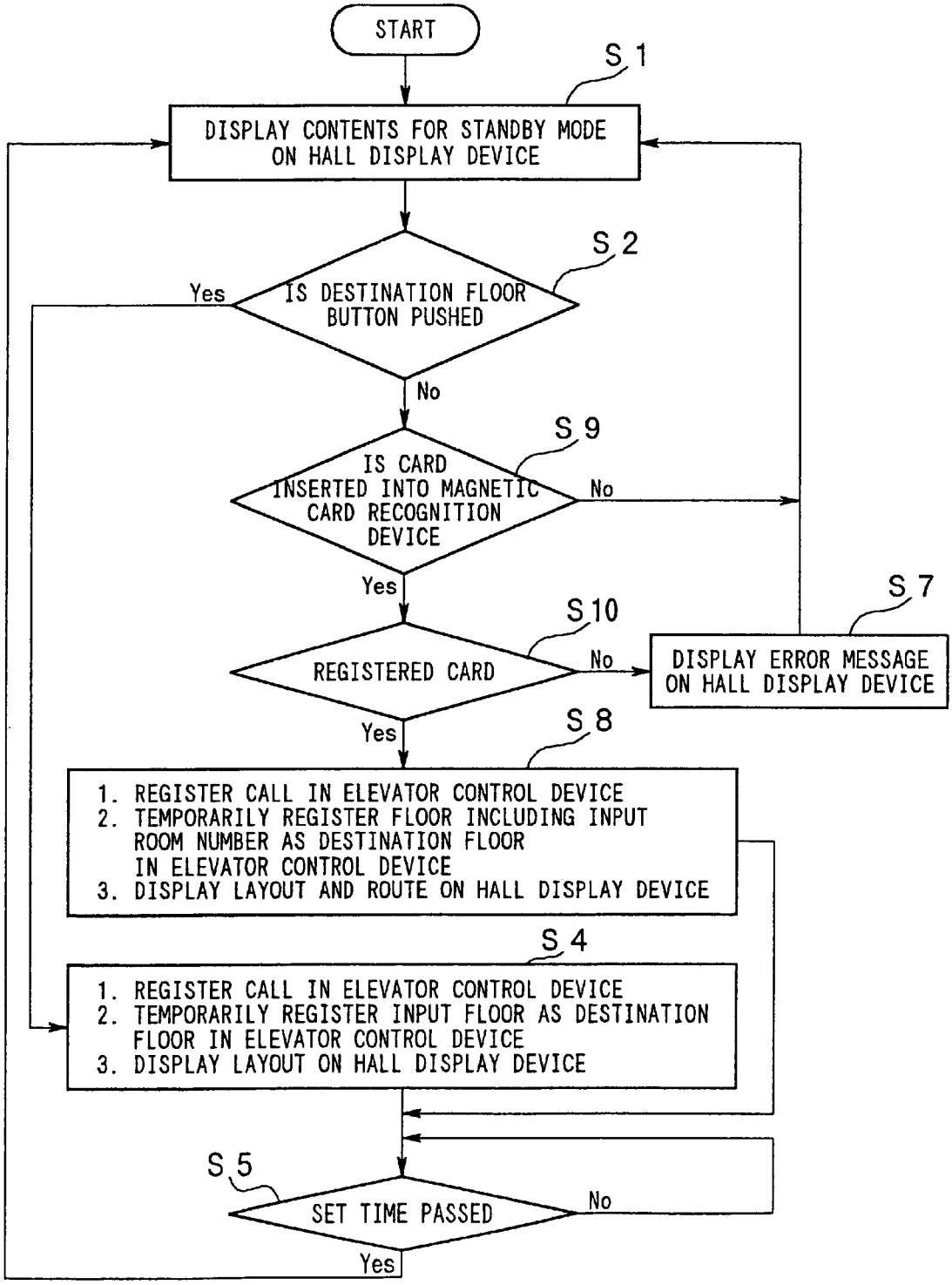
FIG. 10 is a flow chart showing a control method for the destination registering apparatus in FIG. 9.

FIG. 10 is a flow chart showing a control method for the destination registering apparatus in FIG. 9. In a standby state, it is normally checked to see whether a destination floor button 5 is pushed (step S2) or a magnetic card is inserted into the magnetic card recognition device 22 (step 9). If a magnetic card is inserted into the magnetic card recognition device 22, it is checked to see whether the inserted card is registered in the magnetic card registering device 23 (step 10). The other control methods are the same as in the first embodiment.

Thus, the same effect as in the first embodiment can be obtained by using the magnetic card recognition device 22 as the input device. Further, when the ten-key numerical input device 6 is used, anyone can operate it, but since only specified persons have the magnetic card, security can be improved.

Third Embodiment

Figure 11:
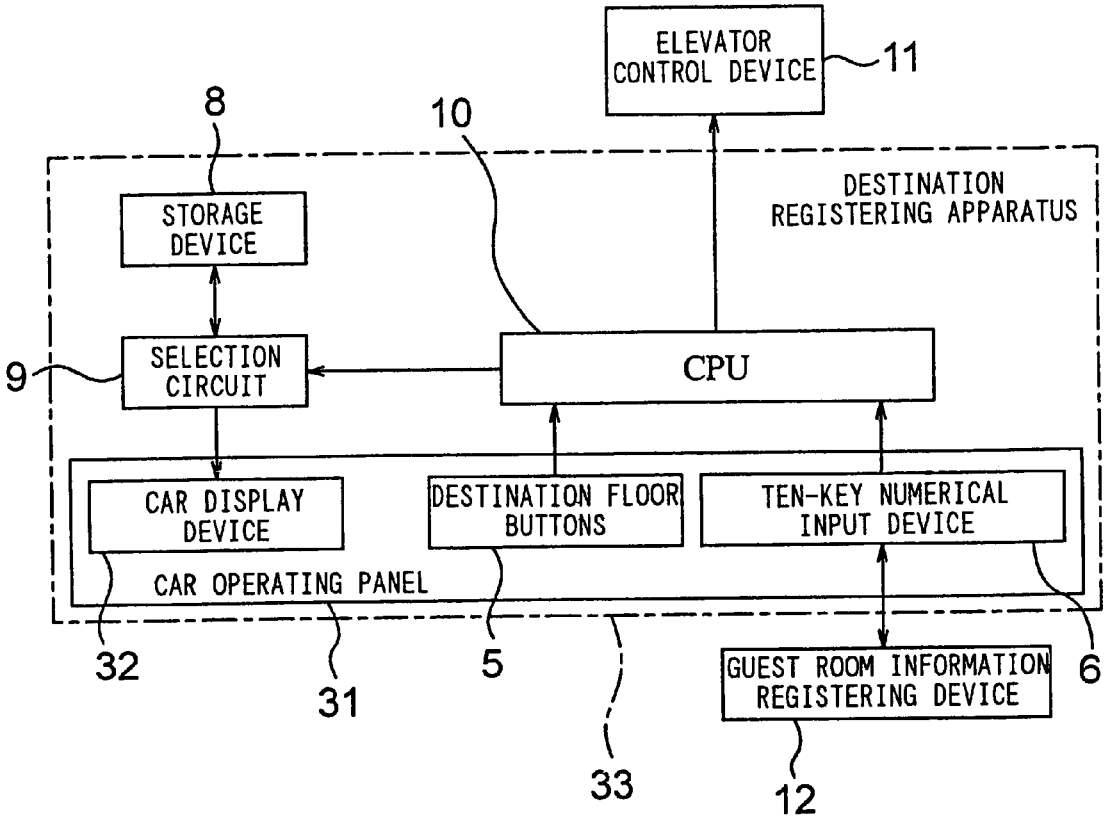
FIG. 11 is a block diagram showing a destination registering apparatus according to a third embodiment of the present invention.

FIG. 11 is a block diagram showing a destination registering apparatus according to a third embodiment of the present invention. In the figure, a car operating panel 31 is provided in a car (not shown). Further, the car operating panel 31 has the same construction as FIG. 2, and has the destination floor buttons 5, the ten-key numerical input device 6 and a car display device 32. A destination registering apparatus 33 according to the third embodiment has the destination floor buttons 5, the ten-key numerical input device 6, the car display device 32, the storage device 8, the selection circuit 9 and the CPU 10. The other constructions are the same as in the first embodiment.

Figure 12:
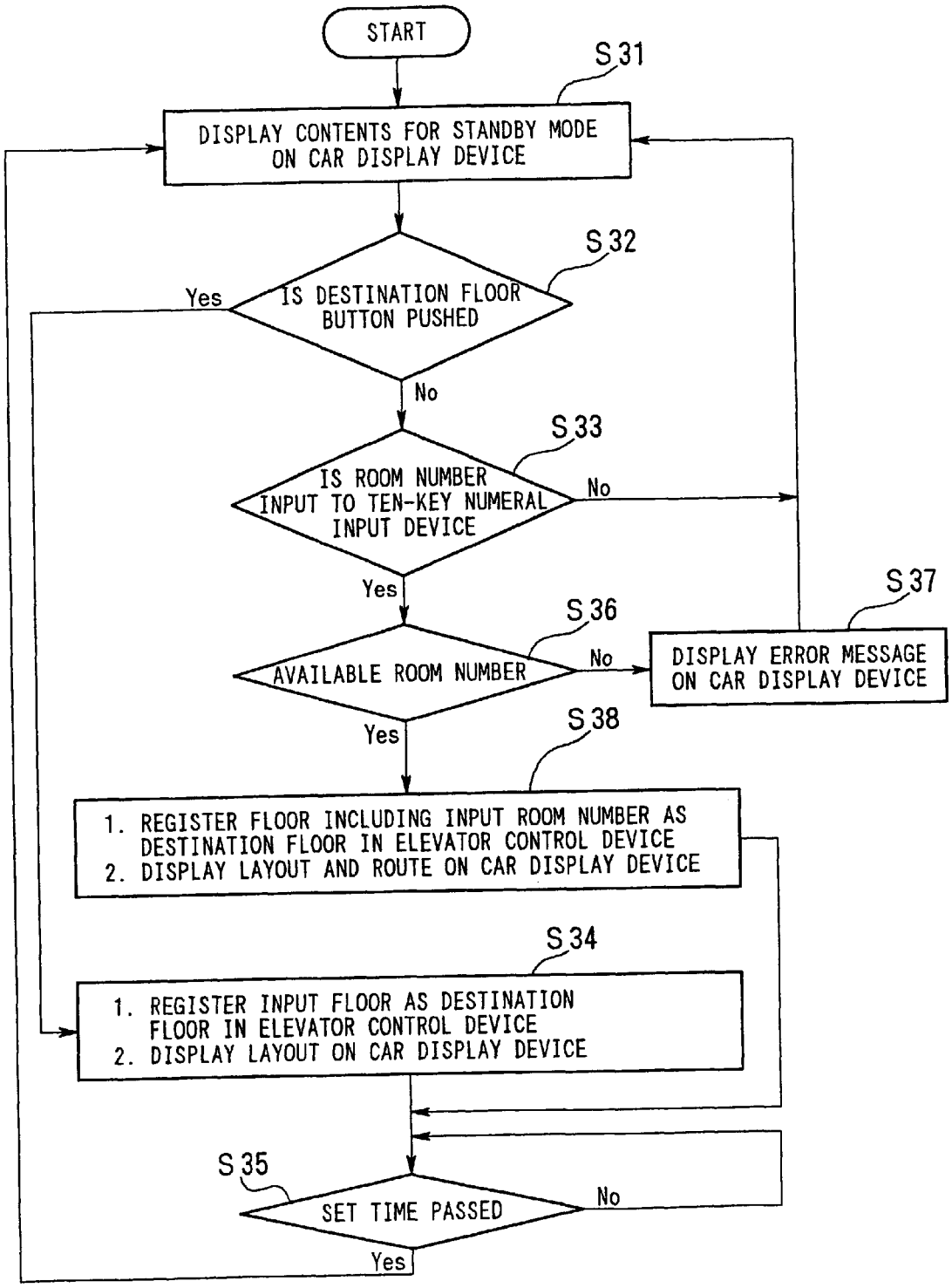
FIG. 12 is a flow chart showing a control method for the destination registering apparatus in FIG. 11.

Next, the operation will be described. FIG. 12 is a flowchart showing a control method for the destination registering apparatus 33 in FIG. 11. First, at the time of standby mode, display contents, such as input waiting messages such as "please enter a registration" or the like, or information on events in a building, are displayed on the car display device 32 (step S31). Then, it is normally checked to see whether a destination floor button 5 is pushed or not (step S32), or whether a room number is input to the ten-key numerical input device 6 (step S33). If no input is received from either the destination floor buttons 5 or the ten-key numerical input device 6, the standby mode display continues.

Further, if a destination floor button 5 is pushed, the input floor is registered in the elevator control device 11 as the destination floor, and the layout of the input floor is displayed on the car display device 32 (step S34). The display of the layout is performed only for a time previously set in a timer circuit in the selection circuit 9 (step S35), and the display in the car display device 32 reverts back to the contents for standby mode after the set time passed.

On the other hand, if a room number is input to the ten-key numerical input device 6, it is checked to see whether the input room number is registered in the guest room information registering device 12 or not (step S36). In the case of no registration, the guest room of the input number is judged not to be available, an error message is displayed on the car display device 32 (step S37). Then, the call registration is refused, and the display reverts back to the standby state.

In the case where the input room number has been registered in the guest room information registering device 12, the floor including the input room number is registered in the elevator control device 11 as the destination floor, and the layout of the corresponding floor and the route to the guest room that is the destination point are displayed on the car display device 32 (step S38). The display of the layout and route is performed only for a time previously set (step S35), and the display in the car display device 32 reverts back to the contents for standby mode after the set time passes.

Although, in the first and second embodiments, the registration of the destination floor in the elevator control device 11 is performed after the car reaches the floor where the call registration is input, in the third embodiment, the registration of the destination floor is performed just after inputting because the call registration is input after the user gets on the car.

Thus, in the case where the ten-key numerical input device 6 and the car display device 32 are provided on the car operating panel 31, since the car display device 32 is hard to see by other users, the layout of the destination floor and the route to the destination point can be preferentially displayed to the user who has input the guest room number.

Further, while, in the first and second embodiments, there is a need to provide a hall operating panel 4 or 21 at each elevator hall, in the third embodiment, only the call buttons are provided at the elevator halls and only one car operating panel 31 is provided in the car, thereby reducing costs.

Fourth Embodiment

Figure 13:
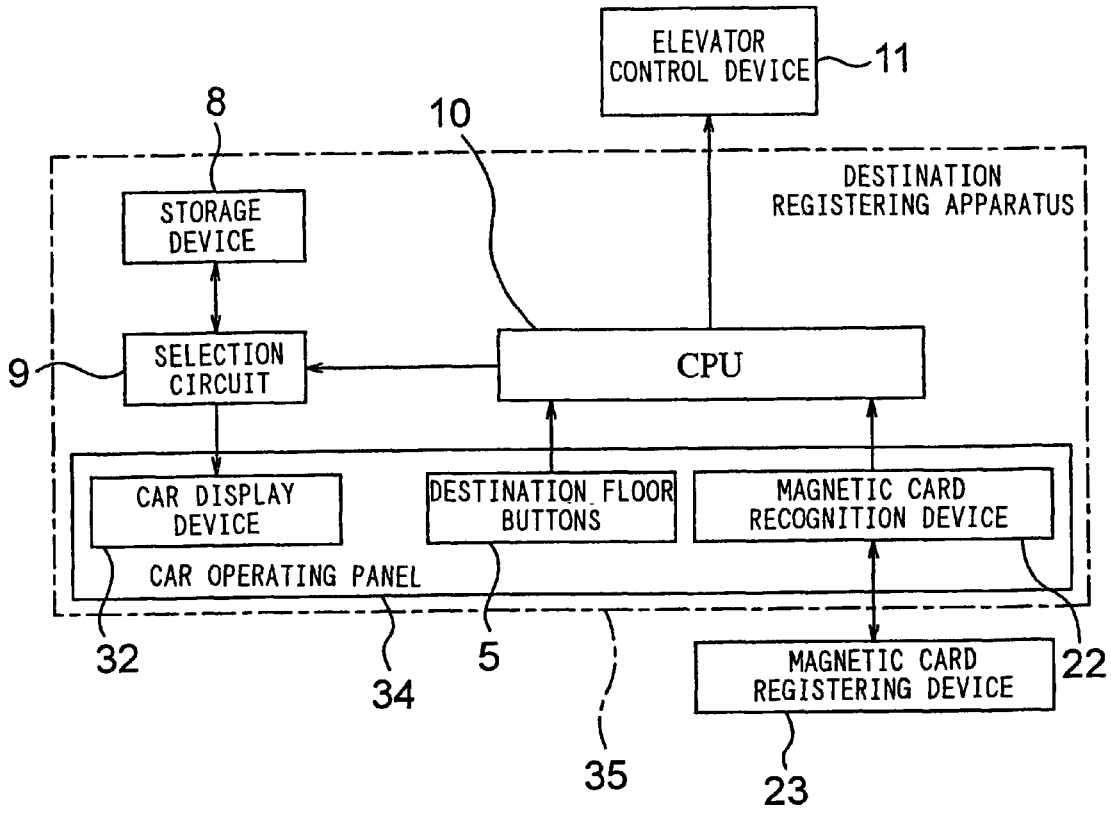
FIG. 13 is a block diagram showing a destination registering apparatus according to a fourth embodiment of the present invention.

FIG. 13 is a block diagram showing a destination registering apparatus according to a fourth embodiment of the present invention. In the fourth embodiment, the magnetic card recognition device 22 as an input device is used in a car operating panel 34. The magnetic card recognition device 22 is connected with the magnetic card registering device 23.

A destination registering apparatus 35 according to the fourth embodiment has the destination floor buttons 5, the magnetic card recognition device 22, the car display device 32, the storage device 8, the selection circuit 9 and the CPU 10. The other constructions are the same as in the first embodiment.

Figure 14:
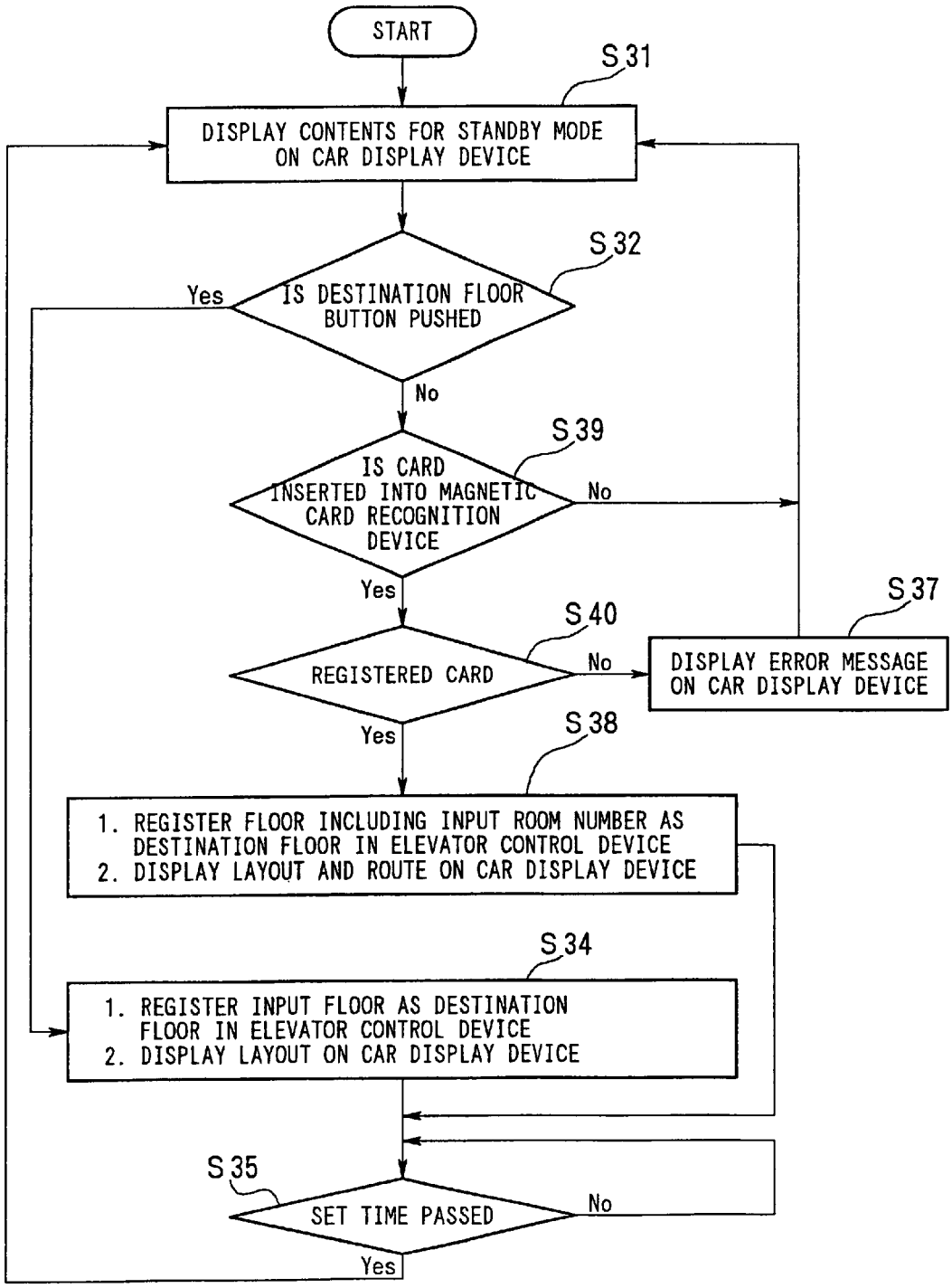
FIG. 14 is a flow chart showing a control method for the destination registering apparatus in FIG. 13.

FIG. 14 is a flow chart showing a control method for the destination registering apparatus 35 in FIG. 13. In the standby state, it is normally checked to see whether a destination floor button 5 is pushed (step S32) or whether the magnetic card is inserted into the magnetic card recognition device 22 (step S39). Then, when the magnetic card is inserted into the magnetic card recognition device 22, it is checked to see whether the input card is registered in the magnetic card registering device 23 (step S40). The other control methods are the same as in the third embodiment.

Thus, the same effect as in the third embodiment can be obtained by using the magnetic card recognition device 22 as the input device. Further, security can be further improved as compared with the case using the ten-key numerical input device 6.

Fifth Embodiment

Figure 15:
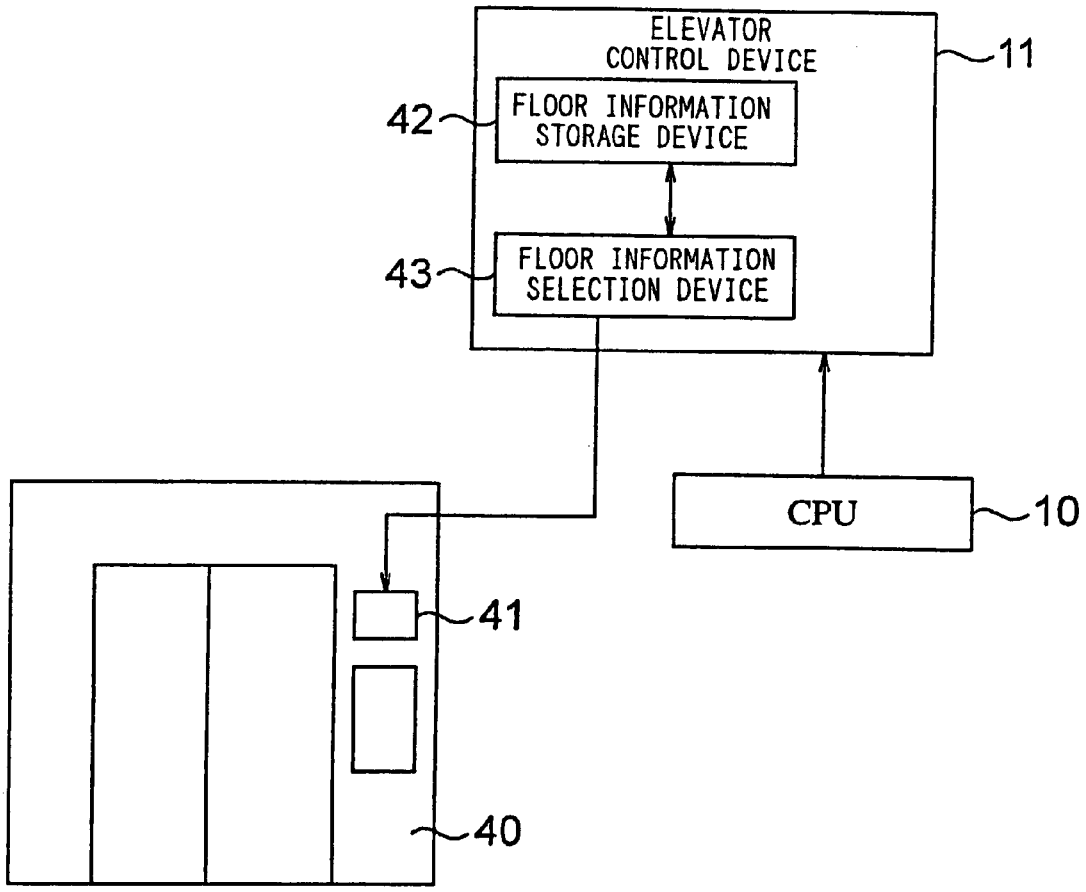
FIG. 15 is a block diagram showing an essential part of a destination registering apparatus according to a fifth embodiment of the present invention.

Next, FIG. 15 is a block diagram showing an essential part of a destination registering apparatus according to a fifth embodiment of the present invention. In the figure, a car display device 41 is provided on a car wall 40. The elevator control device 11 is provided with a floor information storage device 42 in which the layout of each floor is stored, and a floor information selection device 43 by which required information is selected from the floor information storage device 42 and displayed on the car display device 41.

Accordingly, the destination registering apparatus according to the fifth embodiment further has the car display device 41, the floor information storage device 42 and the floor information selection device 43 in addition to the construction of the first or second embodiment.

Figure 16:
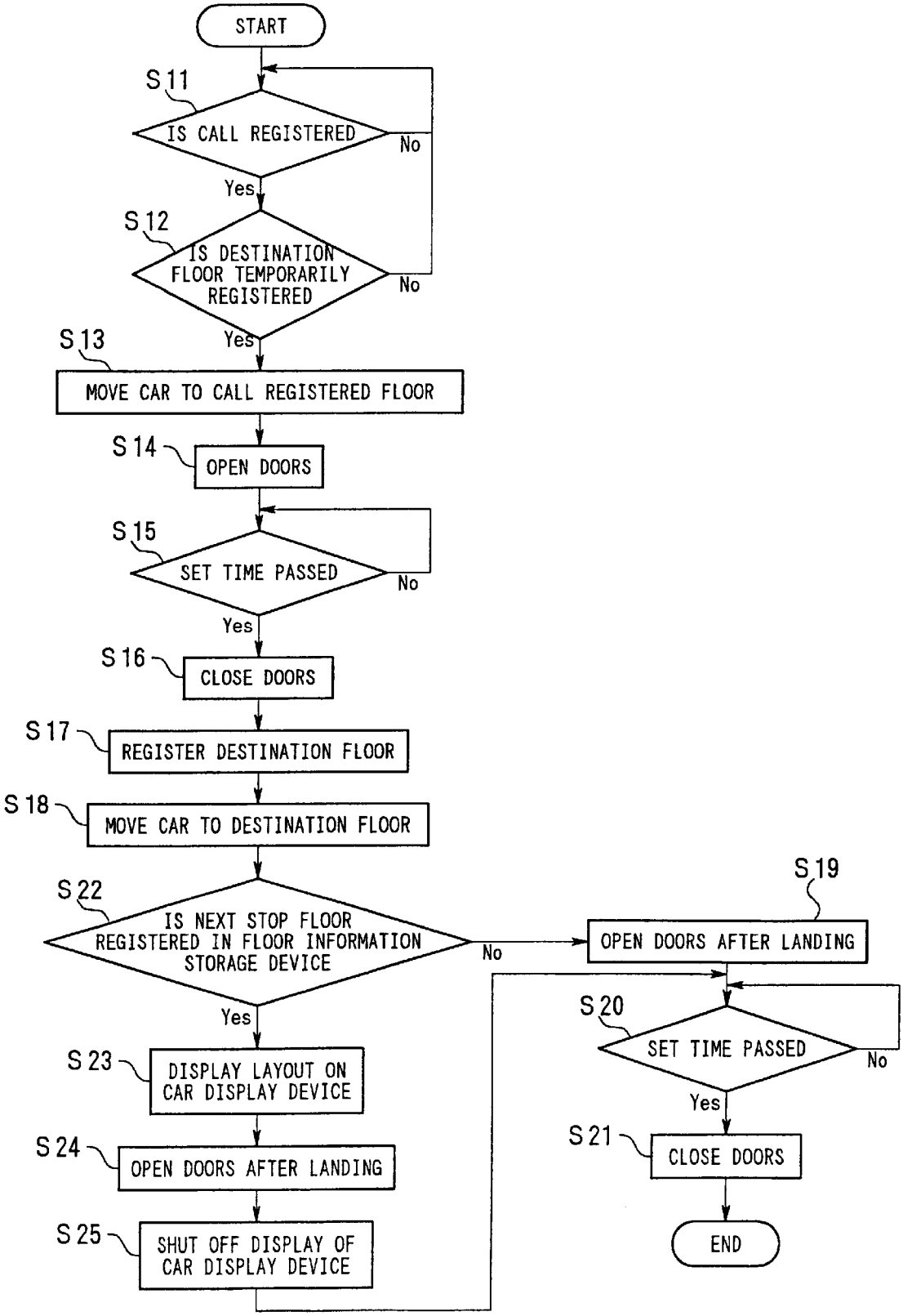
FIG. 16 is a flow chart showing a control method for the elevator control device in FIG. 15.

FIG. 16 is a flow chart showing a control method for the elevator control device in FIG. 15. Basic control methods are the same as in the first embodiment (FIG. 8). In the fifth embodiment, when the car is moved to the destination floor, it is checked to see whether the next stop floor is registered in the floor information storage device 42 (step S22). If not registered, the flow is the same as in the first embodiment.

In the case where the next stop floor is registered, the layout of the next stop floor is displayed on the car display device 41 (step S23). At this time, the route to the destination point as displayed on the hall display device 7 is not displayed. The layout display of the car display device 41 is shut off after landing of the car and opening of the doors (step S25). The subsequent control is the same as in the first embodiment.

Thus, in the fifth embodiment, since the layout of the destination floor is also displayed on the car display device 41 in addition to the display on the hall display device 7, the user can reconfirm, in his or her head, the route to the destination point confirmed at the elevator hall. Further, since the route is not displayed on the car display device 41, there is no fear that the destination point can be seen by other passengers.

It should be noted that, while, in the embodiments described above, the layout of the destination floor and the route to the destination point are displayed on the hall display device or the car display device, it is also possible that an evacuation route can be further displayed.

Further, the input device is not limited to the ten-key numerical input device and the magnetic card recognition device, and various types of input devices can be used.

Furthermore, it should be noted that, while, in the embodiments described above, the destination registering apparatus for an elevator installed in a hotel is explained, the present invention is also applicable to elevators installed in other buildings such as, for example, apartments or department stores.

What is claimed is:

1. A destination registering apparatus for an elevator comprising:

an input device for inputting information that designates a destination point, said input device being located at an elevator hall and said destination point being a room on a floor served by the elevator;

a storage device storing layout information including the layout of every floor served by an elevator and routes from the elevator hall of each floor to every destination point that may be designated on the respective floor;

a selection circuit for selecting layout information corresponding to a destination point designated by information input through said input device, from information stored in said storage device;

a hall display device for displaying information selected by said selection circuit, said hall display device being located at the elevator hall;

a central processing unit for outputting destination registering signals to an elevator control device and outputting information selecting signals to said selection circuit according to the layout information input through said input device; and a registering device in which information corresponding to available destination points is registered, said registering device being connected to said input device, said destination registering apparatus determining whether a destination point input through said input device is registered in said registering device, and destination registering and information selecting signals are output from said CPU only when the destination point designated has been registered.

2. The destination registering apparatus for an elevator according to claim 1, wherein said input device is a ten-key numerical input device.

3. The destination registering apparatus for an elevator according to claim 1, wherein said input device is a magnetic card recognition device.

4. The destination registering apparatus for an elevator according to claim 1, further comprising a car display device located in an elevator car for displaying the layout of the floor to be served next by the elevator car.

5. A destination registering apparatus for an elevator comprising:

an input device for inputting information that designates a destination point, said input device being located at an elevator hall and said destination point being a room on a floor served by the elevator;

a storage device storing layout information including the layout of every floor served by an elevator and routes from the elevator hall of each floor to every destination point that may be designated on the respective floor;

a selection circuit for selecting layout information corresponding to a destination point designated by information input through said input device, from information stored in said storage device;

a hall display device for displaying information selected by said selection circuit, said hall display device being located at the elevator hall; and a central processing unit for outputting destination registering signals to an elevator control device and outputting information selecting signals to said selection circuit according to the layout information input through said input device, wherein evacuation routes from every destination point are stored in said storage device, and, during an emergency, the layouts, the routes, and the evacuation routes are displayed on said hall display device.

6. The destination registering apparatus for an elevator according to claim 5, wherein said input device is a ten-key numerical input device.

7. The destination registering apparatus for an elevator according to claim 5, wherein said input device is a magnetic card recognition device.

8. The destination registering apparatus for an elevator according to claim 5, further comprising a car display device located in an elevator car for displaying the layout of the floor to be served next by the elevator car.

9. A destination registering apparatus for an elevator comprising:

an input device for inputting information that designates a destination point, said input device being located in an elevator car, and said destination point being a room on a floor served by the elevator;

an elevator car operating panel having a display device for displaying an image to an elevator passenger who has operated said input device;

a storage device storing layout information including the layout of every floor served by an elevator and routes from the elevator hall of each floor to every destination point that may be designated on the respective floor;

a selection circuit for selecting layout information corresponding to a destination point designated by information input through said input device, from information stored in said storage device and displaying the information on said car display device;

a central processing unit for outputting destination registering signals to an elevator control device and outputting information selecting signals to said selection circuit according to the layout information input through said input device; and a registering device in which information corresponding to available destination points is registered, said registering device being connected to said input device, said destination registering apparatus determining whether a destination point input through said input device is registered in said registering device, and destination registering and information selecting signals are output from said CPU only when the destination point designated has been registered.

10. The destination registering apparatus for an elevator according to claim 9, wherein said input device is a ten-key numerical input device.

11. The destination registering apparatus for an elevator according to claim 9, wherein said input device is a magnetic card recognition device.

12. A destination registering apparatus for an elevator comprising:

an input device for inputting information that designates a destination point, said input device being located in an elevator car, and said destination point being a room on a floor served by the elevator;

an elevator car operating panel having a display device for displaying an image to an elevator passenger who has operated said input device;

a storage device storing layout information including the layout of every floor served by an elevator and routes from the elevator hall of each floor to every destination point that may be designated on the respective floor;

a selection circuit for selecting layout information corresponding to a destination point designated by information input through said input device, from information stored in said storage device and displaying the information on said car display device; and a central processing unit for outputting destination registering signals to an elevator control device and outputting information selecting signals to said selection circuit according to the layout information input through said input device, wherein evacuation routes from every destination point are stored in said storage device, and, during an emergency, the layouts, the routes, and the evacuation routes are displayed on said display device.

13. The destination registering apparatus for an elevator according to claim 12, wherein said input device is a ten-key numerical input device.

14. The destination registering apparatus for an elevator according to claim 12, wherein said input device is a magnetic card recognition device.

* * * * *